US005164283A

United States Patent [19]

Niimura et al.

[11] Patent Number: 5,164,283

[45] Date of Patent: Nov. 17, 1992

[54] ELECTROPHOTOGRAPHIC DEVELOPING POWDER

[75] Inventors: Isao Niimura; Mitsutoshi Anzai; Hiroyoshi Yamaga; Noboru Akuzawa, all of Tokyo, Japan

[73] Assignee: Hodogaya Chemical Co., Ltd., Tokyo, Japan

[21] Appl. No.: 781,641

[22] Filed: Oct. 25, 1991

Related U.S. Application Data

[63] Continuation of Ser. No. 507,405, Apr. 11, 1990, abandoned.

[30] Foreign Application Priority Data

Apr. 20, 1989 [JP] Japan ..... 1-98950

[51] Int. Cl.[5] ..... G03G 9/097

[52] U.S. Cl. ..... 430/110; 430/106.6; 430/108

[58] Field of Search ..... 430/106, 106.6, 108, 430/110

[56] References Cited

U.S. PATENT DOCUMENTS 4,824,751 4/1989 Matuura et al. ..... 430/110
4,857,432 8/1989 Tanikawa ..... 430/110
4,954,409 9/1990 Aoki et al. ..... 430/110

FOREIGN PATENT DOCUMENTS 251326 1/1988 European Pat. Off. .
360617 3/1990 European Pat. Off. .
376717 7/1990 European Pat. Off. .

OTHER PUBLICATIONS

Patent Abstracts of Japan, vol. 12, No. 133 (P-693)[2980], Apr. 22, 1988; & JP-A-62 255 958, (Nippon), Jul. 11, 1987, *Whole abstract*.

Patent Abstracts of Japan, vol. 12, No. 29 (P-660) [2876], Jan. 28, 1988; & JP-A-62 182 752, (Konishiroku), Aug. 11, 1987, *Whole abstract*.

*Primary Examiner*—John Goodrow

*Attorney, Agent, or Firm*—Oblon, Spivak, McClelland, Maier & Neustadt

[57] ABSTRACT

An electrophotographic developing powder comprising a resin, a coloring agent and a compound of the following formula, as a charge-controlling agent:

(I)

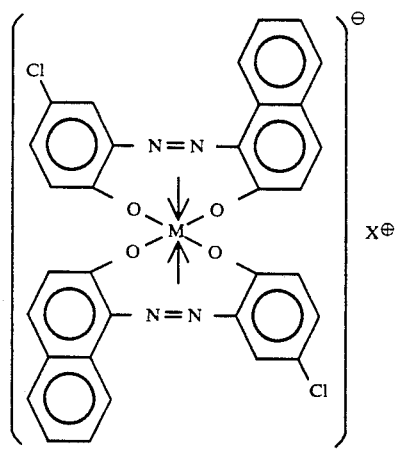

wherein X is sodium or potassium, and M is a chromium or cobalt atom.

7 Claims, No Drawings

ELECTROPHOTOGRAPHIC DEVELOPING POWDER

This application is a continuation of application Ser. No. 07/507,405, filed on Apr. 11, 1990, now abandoned.

The present invention relates to an electrophotographic developing powder.

The present invention generally relates to a toner composition. More particularly, the present invention relates to a developing agent or a toner composition containing a charge-controlling agent which imparts a negative charge to toner particles. One of the embodiments of the present invention is a toner composition comprising a resin, a coloring agent and a sodium salt of a chromium complex of an azo dye obtained from 4-chloro-2-aminophenol and β-naphthol. This toner composition is useful for developing an electrostatic latent image to a blue color image. Such an additive shows a negative response in a mutation test and is believed to be non-toxic. A developer composition containing a charge controlling agent which imparts a positive charge to toner particles, is known. For example, Japanese Examined Patent Publication No. 10308/1985 discloses a positive charge-type toner composition containing a resin, a pigment and an alkylpyridinium compound as a charge-controlling agent. Further, publications disclosing positive charge-type toner compositions containing charge-controlling agents includes, for example, U.S. Pat. No. 3,893,935 and Japanese Unexamined Patent Publications No. 119364/1982, No. 107654/1985 and No. 106859/1985. Furthermore, toner compositions containing negative charge-controlling agents like the present invention, are disclosed in Japanese Examined Patent Publications No. 27596/1968 and No. 6397/1969 and Japanese Unexamined Patent Publication No. 78361/1984.

Although a number of charge-controlling agents are known, it is still desired to obtain an additive which is capable of imparting a negative charge to a toner resin and providing a constant frictional electrification properties. To comply with the demands for a high image quality, high speed printing and maintenance free for printers including copying machines, a developing agent for a toner useful for continuous printing for a long period of time is desired, and a charge-controlling agent which satisfies such requirements, is strongly desired.

The present inventors have conducted various studies to solve such problems and as a result, have accomplished the present invention.

The present invention provides a toner composition comprising a resin, a coloring agent and a metal complex compound of the following formula (I) as a charge-controlling agent:

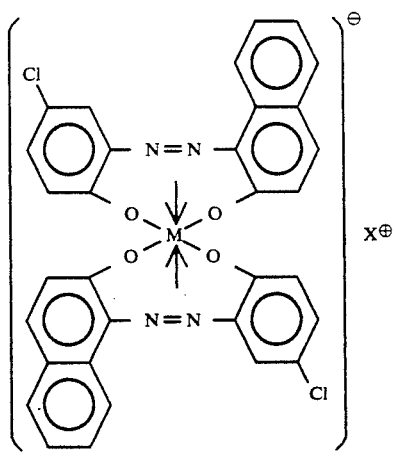

(I)

wherein X is sodium or potassium, and M is a chromium or cobalt atom.

Now, the present invention will be described in detail with reference to the preferred embodiments.

The metal complex compound of the formula as the charge-controlling agent is usually prepared in such a manner that 4-chloro-2-aminophenol is diazotised, followed by coupling with 2-naphthol to readily obtain a monoazo compound, then this monoazo compound is treated with a corresponding metal chelating agent in water or in a suitable organic solvent to obtain the metal complex.

Further, by treating the counter ion with the corresponding metal hydroxide, it can readily be converted to a sodium or a potassium salt of a 1:2 type metal azo complex compound.

Specific examples of the toner resin suitable for use in the toner composition or developer composition of the present invention, include a polyamide, an epoxy resin, a polyurethane, a vinyl resin including a homopolymer of a vinyl monomer and a copolymer of two or more vinyl monomers, and a high molecular weight ester exchange product of a dicarboxylic acid with a diol including diphenol. The vinyl monomers include styrene, p-chlorostyrene, vinyl naphtarene; unsarturated monoolefins such as ethylene, propylene, butylene and isobutylene; vinyl halides such as vinyl chloride, vinyl bromide and vinyl fluoride; vinyl acetate, vinyl propionate, vinyl benzoate and vinyl butyrate; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, methyl α-chloroacrylate, methyl methacrylate, ethyl methacrylate and butyl methacrylate; acrylonitrile, methacrylonitrile and acrylamide; vinyl ethers such as vinyl methyl ether, vinyl isobutyl ether and vinyl ethyl ether; vinyl ketones such as vinyl methyl ketone, vinyl hexyl ketone and methyl isopropenyl ketone; vinylidene halides such as vinylidene chloride and vinylidene chlorofluoride; N-vinyl indole and N-vinyl pyrrolidone; a styrene-butadiene copolymer; and mixtures thereof.

Further, polyethylene, polypropylene or a wax having a molecular weight of from about 1,000 to about 6,000 such as paraffin, may be incorporated to the toner resin particles as a releasing agent for fixing machine rollers.

The resin particles are used in a sufficiently effective amount. Namely, when 5% by weight of a metal complex compound is present and 10% by weight of a pigment i.e. a coloring agent such as carbon black, is contained, about 85% by weight of the resin is used.

Usually, from about 0.25 to about 10% by weight, preferably from about 1 to about 5% by weight, of a charge-controlling agent is incorporated to the toner particles. However, the charge-controlling agent may be used in other various amounts so long as the object of the present invention can be accomplished. The charge-controlling agent of the present invention may be mixed to the toner composition or may be coated on the pigment particles. When coated, the charge-controlling agent of the present invention is present usually in an amount of from about 0.1 to about 5% by weight, preferably from about 0.3 to about 1% by weight.

Many well-known pigments or dyestuffs may suitably be used as the coloring agent for the toner particles. The coloring agent includes, for example, carbon black, a nigrosine dye, aniline blue and a mixture therof. The pigment is preferably carbon black, and it should be present in an adequate amount to highly color the toner composition. Usually, the pigment particles are present in an amount of from about 3 to about 20% by weight, based on the total weight of the toner composition. However, a larger or smaller amount of the pigment particles may be employed so long as the object of the present invention can thereby be accomplished.

When the pigment particles are composed of magnetite which is a mixture of iron oxides ($FeO.FeO_2$) commercially available as Mapico Black, such magnetite is present in an amount of from about 10 to about 70% by weight, preferably from about 10 to about 50% by weight.

Further, a color toner composition comprising toner resin particles, carrier particles, the above-mentioned charge-controlling agent and the pigment, i.e. magenta, cyan and/or yellow particles, or a mixture thereof, as the coloring agent, also belongs to the scope of the present invention. More specifically, specific examples of the magenta substance useful as the pigment for the formation of a color image by means of the developer composition containing the charge-controlling agent of the present invention, include for example, 2, 9-dimethyl-substituted quinacridone, an anthraquinone dye disclosed as CI60710, CI Dispersed Red 15 in the color index and a diazo dye disclosed as CI26050, CI Solvent Red 19 in the color index. The cyan substance used as the pigment includes, for example, copper tetra-4 (octadecylsulfonamide)phthalocyanine, an X-copper phthalocyanine pigment disclosed as CI74160, CI Pigment Blue in the color index and an anthracene blue disclosed as CI69810, Special Blue-X-2137 in the color index. Likewise, specific examples of the useful yellow pigment includes, for example, diallylide yellow 3,3-dichlorobentydene acetacetanilide, a monoazo pigment disclosed as CI12700, CI Solvent Yellow 16 in the color index, a nitrophenylaminsulfonamide disclosed as Phorone Yellow SE/GLN, CI Dispersed Yellow 33 in the color index, 2,5-dimethoxy-4-sulfonanilidephenylazo-4-chloro-2,5-dimethoxyaceto-acetanilide and Permanent Yellow FGL.

The above pigments may be incorporated in various suitable effective amounts to the toner composition so long as the object of the present invention can thereby be accomplished. In one embodiment, such color pigment particles are present in an amount of from about 2 to about 15% by weight based on the weight of the toner particles in the toner composition.

To prepare a developer composition, carrier particles, particularly those which can triboelectronically secure a polarity opposite to the polarity of the toner composition, are mixed with toner particles. Accordingly, the carrier particles of the present invention are selected so that they have a positive polarity so that negatively charged toner particles can attach to the carrier particles. Specific examples of such carrier particles include iron powder, steel, nickel, iron ferrite and silicon dioxide. Further, a granular nickel carrier as disclosed in U.S. Pat. No. 3,847,604 may also be used as the carrier particles of the present invention. The carrier particles may be used with or without coating. The coating is usually composed of a terpolymer of styrene, methyl methacrylate and a silane such as triethoxysilane (U.S. Pat. Nos. 3,526,533 and 3,467,634), or other known coatings may be employed.

The diameter of the carrier particles is usually from about 50 μm to about 1,000 μm, whereby the carrier particles will have an adequate density and inertia so as to avoid the deposition to the electrostatic image during the developing process. The carrier component may be mixed with the toner composition in various suitable combinations. However, the best results will be obtained when from about 1 to about 5 parts by weight of the toner is used relative to about 10 to about 200 parts by weight of the carrier.

The toner composition of the present invention may be prepared by various known methods which comprise melt-mixing the toner resin particles, pigment particles i.e. the coloring agent, and the charge-controlling agent of the present invention, followed by mechanically abrading and pulverizing the mixture. Other methods include those well-known in this technical field, such as sprayed drying, melt dispersion, dispersion polymerization and suspension polymerization. In one embodiment, a solvent dispersion of resin particles, pigment particles and a charge-controlling agent, is prepared and then spray-dried to obtain a desired product.

The toner or developer composition of the present invention is useful in a usual electrostatic photographic image-forming device containing a photoconductor which can be positively electrified. The positive electrification is usually caused by an inorganic photoconductor. Specific examples of such an inorganic photoconductor include selenium, a selenium alloy, a halogen-doped selenium material and a halogen-doped selenium alloy. Further, the toner or developer composition of the present invention may be used together with a photoconductor which can be negatively charged, as disclosed in U.S. Pat. No. 4,265,990. In such a case, the discharge region will be developed by the toner. Other similar photoconductors may likewise be employed so long as the object of the present invention can be achieved.

Now, the present invention will be described in further detail with reference to Examples. These examples are intended to make various features of the present invention clear, and they are given for the purpose of illustration. Therefore, it should be understood that the present invention is by no means restricted by such specific Examples. In these Examples, "parts" and "%" mean "parts by weight" and "% by weight" unless otherwise specified.

EXAMPLE 1

14.5 parts of 4-chloro-2-aminophenol was dissolved in 26 parts of concentrated hydrochloric acid and 200 parts of water, and 6.9 parts of sodium nitride was added at a temperature of from 0° to 5° C. for diazotization.

Then, 14.4 parts of 2-naphthol and 6 parts of sodium hydroxide were dissolved in 300 parts of water, and the solution was added to the above diazotized solution at a temperature of from 0° to 5° C. for coupling. Then, the formed precipitates were collected by filtration. To the wet cake, 300 parts of ethylene glycol and 13 parts of chromium acetate were added, and the mixture was stirred at a temperature of from 85° to 90° C. for three hours to obtain a chromium complex compound, which was then cooled to room temperature, and 10 parts of sodium hydroxide was added. The mixture was stirred at room temperature for two hours, followed by filtration, washing with water and dried to obtain 33 parts of the following sodium salt of a metal complex azo compound.

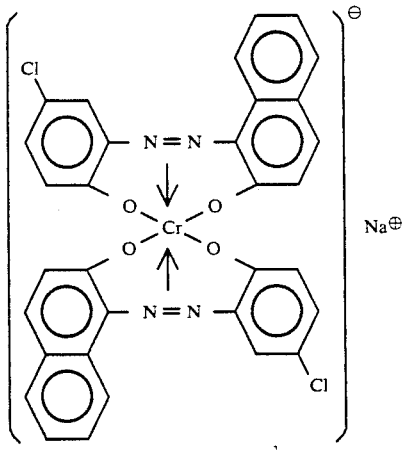

Then, 7 parts of carbon black (R- 400R, manufactured by Cabot Corp.) and 2 parts of the above sodium salt of the metal complex azo compound were mixed to 100 parts of a styrene synthetic resin (HIMER-TB-1000, manufactured by Sanyo Kasei K.K.), and the mixture was heated and melted. After cooling, the mixture was roughly pulverized by a mixer. The roughly pulverized powder was further pulverized by a jet-mil and classified to obtain a negatively electrifiable toner having a particle size of from 10 to 20 μm. Then, this toner was mixed with a coating carrier of from 100 to 200 mesh (F96-100, manufactured by Nippon Teppun K.K.) in a weight ratio of 5:100 to obtain a developing agent. By using this developing agent, continuous printing was conducted by a laser printer (4105, manufactured by FUJI XEROX K.K.). The results are shown in the following Table.

For the purpose of the comparison, compounds were synthesized in the same manner as in the above Example with respect to known compounds similar to the present inveniton, and the developing agents were prepared and the continuous printing was conducted in the same manner as the above Example. The results are shown below.

Results of Continuous Printing

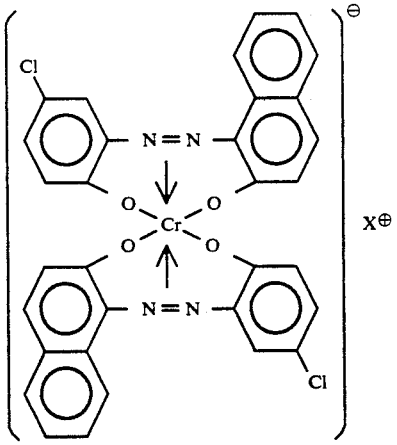

| Structure of the compound ($X^+$) | 10,000th copy Charge distribution (−μc/g) (Image quality) | 50,000th copy Charge distribution (−μc/g) (Image quality) | 500,000th copy Charge distribution (−μc/g) (Image quality) |
|---|---|---|---|
| Compound of the present invention ($X^+ = Na^+$) | 17.2–17.1 (Excellent) | 17.0–17.1 (Excellent) | 17.0–17.1 (Excellent) |

-continued

| | | | |
|---|---|---|---|
| Compound of Japanese Examined Patent Publication No. 6397/1969 ($X^+ = NH_4^+$) | 12.1-18.5 (Fair) | 5.8-20.5 (Poor) | 2.1-25.5 (Poor) |
| Compound of Japanese Unexamined Patent Publication No. 78361/1984 ($X^+ = H^+$) | 18.5-20.1 (Excellent) | 15.2-21.1 (Fair) | 10.5-23.2 (Poor) |

From the above results, it is evident that as compared with the known compounds, in the case of the present invention, no substantial change in electrification is observed in the continuous printing test, and the electrification is stable, and a printed product of high quarity is obtainable without no substantial change in the image quality.

Instead of the metal complex azo compound in Example 1, it was possible to use the compounds having the following formulas.

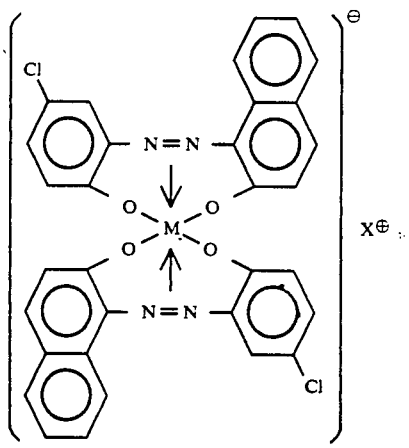

| M | X⊕ |
|---|---|
| Co | K⊕ |
| Cr | K⊕ |
| Co | Na⊕ |

Further, instead of the styrene resin in Example 1, it was possible to employ an epoxy resin, a polyester resin, a styrene-acrylate copolymer.

We claim:

1. An electrophotographic developing powder comprising a resin, a coloring agent and a compound of the following formula, as a charge-controlling agent:

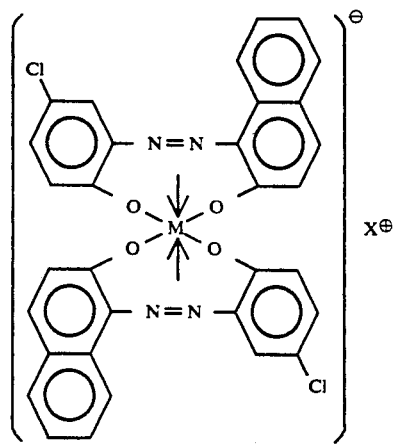

(I)

wherein X is sodium and M is a chromium atom.

2. The electrophotographic developing powder according to claim 1, wherein the compound of the formula (I) is present in an amount of from 0.2 to 5% by weight.

3. The electrophotographic developing powder according to claim 1, wherein the resin is a homopolymer of styrene or an acrylate, or a copolymer thereof.

4. The electrophotographic developing powder according to claim 1, wherein the resin is a polyester homopolymer or a copolymer with styrene.

5. The electrophotographic developing powder according to claim 1, wherein the coloring agent is carbon black or magnetite.

6. A developer composition comprising ferrite or iron powder as a carrier and the developing powder as defined in claim 1.

7. A developer composition according to claim 6, wherein the carrier is cores having a coating thereon.

* * * * *